US007907148B1

(12) United States Patent
Srinivasan et al.

(10) Patent No.: US 7,907,148 B1
(45) Date of Patent: Mar. 15, 2011

(54) INTELLIGENT COLOR REMAPPING OF VIDEO DATA

(75) Inventors: Sujith Srinivasan, Bangalore (IN); Nikhil Balram, Mountain View, CA (US)

(73) Assignee: Marvell International Ltd., Hamilton (BM)

( * ) Notice: Subject to any disclaimer, the term of this patent is extended or adjusted under 35 U.S.C. 154(b) by 1111 days.

(21) Appl. No.: 11/296,163

(22) Filed: Dec. 7, 2005

(51) Int. Cl.
*G09G 5/02* (2006.01)

(52) U.S. Cl. ..... 345/589; 382/167; 345/590

(58) Field of Classification Search ..... 345/589–605; 348/650; 382/162, 165, 167
See application file for complete search history.

(56) References Cited

U.S. PATENT DOCUMENTS

| | | | | |
|---|---|---|---|---|
| 5,289,295 | A * | 2/1994 | Yumiba et al. | 358/518 |
| 5,384,601 | A * | 1/1995 | Yamashita et al. | 348/577 |
| 6,728,406 | B1 * | 4/2004 | Murao | 382/191 |
| 2001/0043368 | A1 * | 11/2001 | Morikawa | 358/458 |
| 2004/0013296 | A1 * | 1/2004 | Aotsuka | 382/162 |
| 2004/0239814 | A1 * | 12/2004 | Hirashima et al. | 348/649 |

* cited by examiner

*Primary Examiner* — Xiao M Wu
*Assistant Examiner* — Scott E Sonners

(57) ABSTRACT

The color remapping system places axes on the Cb-Cr color plane to differentiate and isolate colors of interest. Each axis has a programmable position, hue change value and saturation change value. Input pixels from the video data stream are calibrated with respect to the axes and enhanced based upon the two neighboring axes adjacent to the input pixels. The system can be reconfigured in real time by repositioning the axes and changing their hue and saturation change values. The system is easy to program and reconfigure and provides visually pleasing enhancements to the digital video.

10 Claims, 5 Drawing Sheets

$$hue \cong \theta = \tan^{-1}\left(\frac{v}{u}\right)$$

$$chroma \cong \rho = \sqrt{u^2 + v^2}$$

*hue determines the color*

*chroma determines the saturation or vividness of the color*

INTELLIGENT COLOR REMAPPING OF VIDEO DATA

FIELD OF THE INVENTION

The present invention relates generally to image and video processing, and more particularly to color remapping in image signals.

BACKGROUND OF THE INVENTION

Color enhancement is one of the most common processing tasks used in digital displays and video equipment. The color enhancement is usually done on digital video data using logic that will be implemented by dedicated hardware on an ASIC. In this environment, a color enhancer should be easy to implement and program, should use as few gates as possible and most importantly should not cause undesirable artifacts in the output picture. Because video enhancements are usually judged by visual inspection and the effect they have on viewers, artifacts refer to visually unpleasant portions in an output picture such as loss of details, contouring etc.

Color enhancements are usually performed on data that is in the YCbCr format because YCbCr is a common format for video transmission and interchange and usually obviates color space conversions. The YCbCr format has the advantage that the color information of a pixel is isolated from the brightness or luminance information. Accordingly, color processing is cleanly defined in YCbCr format and simple to implement as opposed to, for example, data in RGB form.

Conventional color enhancements include the common features of changing brightness, contrast, saturation and hue of the whole picture at one time. In other words, the controls are global across the entire video stream and are independent of pixel color and location. A typical requirement in modern video processing is to selectively adjust different colors in a picture independently of each other. For example, it may be required to make red pixels more yellowish and sky blue pixels more vivid while keeping all other pixels unmodified.

An appreciation of the present invention and its improvements can be obtained by reference to the accompanying drawings, which are briefly summarized below, to the following detailed description of illustrated embodiments of the invention, and to the appended claims.

DETAILED DESCRIPTION OF THE PREFERRED EMBODIMENT

Figure 1:
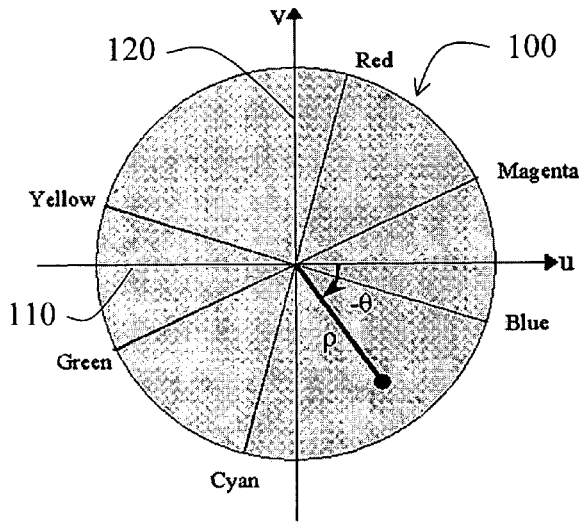
FIG. 1 illustrates the concepts of color hue and color saturation in the YUV color space.

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, or data signal. Referring to the drawings, like numbers indicate like parts throughout the views.

Various embodiments as discussed below can be incorporated into a video processing system such as described in U.S. patent application Ser. No. 11/296,185 filed Dec. 7, 2005, entitled "Color Management Unit," the disclosure of which is expressly incorporated herein by reference.

A typical requirement in modern video processing is to selectively adjust different colors in a picture independently of each other. Selectively adjusting different colors typically involves identifying a particular color and then modifying pixels of that color without changing pixels of other colors. The enhancements made by selectively adjusting different colors can make the output video more pleasing to watch, for example, by making green grass greener, or providing various kinds of special effects.

Two main approaches for selective color enhancement include the lookup table- (LUT-) based approach and the primary color based approach. In the LUT based approach, an LUT is used to map input pixels to output. The input pixel is the address and the output pixel is the data at that address location. The LUT may be one, two or three dimensional depending on the color space of the video data and required functionality. The size of the LUT can be reduced by mapping a limited number of points and interpolating the remaining points. An advantage of the LUT-based approach is that the method is independent of color space and it can provide an accurate color remapping. However, the major drawback is that it is comparatively difficult to program the LUT-based upon a specific enhancement requirement. In real-time video for example, the requirements change constantly (e.g., in response to a user manipulating an on-screen OSD of a display) and re-computing and programming of the LUT largely remains a difficult and expensive task.

In the primary color based approach, the primary colors (red, green, blue) and their complementary colors (cyan, magenta and yellow) are identified and modified independently. This approach is much easier to program and implement than the LUT based approach but has several drawbacks. Firstly, it is limited to a few primary and complementary colors and thus does not effectively handle arbitrary color specifications. Secondly, although predetermined colors can be modified, the primary color approach does not provide a way to gradually taper the changes for neighboring colors. Tapering and blending of colors is very important when dealing with video. For example, a flower that looks red may in fact have half its pixels outside the core region of predefined red and the remaining half inside the red region. If red alone is enhanced, for example, half the flower would be enhanced while the other half that is outside the core red region would remain unmodified with the result being that the flower looks unnatural and even worse than the original. Undesirable situations such as this occur frequently and can cause many visually distracting artifacts due to unnatural enhancements.

The present invention is directed to a color remapping system places that places axes on the Cb-Cr color plane to differentiate and to isolate colors of interest. Each axis has a programmable position, hue change value and saturation change value. Input pixels from the video data stream are calibrated with respect to the axes and enhanced based upon the two neighboring axes adjacent to the input pixels. The system can be reconfigured in real time by repositioning the axes and changing their hue and saturation change values. The system is easy to program and reconfigure and provides visually pleasing enhancements to the digital video.

The system provides the ability to select any color to enhance; not limited to primary and complementary colors and to select different processing parameters for a number of different colors simultaneously. The changes of any enhancement can be gradually tapered such that visually distracting artifacts are not created. Additionally, the system is able to combine global hue and saturation changes with color-dependent changes. The changes can be accomplished without affecting the luminance of pixels. The system is less computationally intensive compared to the LUT-based approach and is typically more flexible compared to the primary color approach.

The YCbCr color space is presently one of the most common video exchange formats. An important feature of this color space is that the luminance (brightness) and chrominance or chroma (color) components of the video signal are separated, and hence the components can be processed and enhanced independently. "Y" is the luminance (usually referred to as luma) of the video while "Cb" and "Cr" are the chroma components. Another advantage of transmitting signals in YCbCr format is that the bandwidth of the signal can also be conserved by downsampling the chrominance signals (because the human eye is more sensitive to brightness than to color). In an example 8-bit system, Y, Cb and Cr are assumed to vary from 0 to 255.

FIG. 1 illustrates the calculation of hue and chroma of a YUV pixel. The horizontal axis (110) of color wheel 100 represents the "U" component of a YUV pixel, while the vertical axis (120) of graph 100 represents the "V" component of a YUV pixel. When the chroma components Cb and Cr are represented with a range of −128 to 127 (by removing an offset of 128), the color space is often referred to as YUV. The axis U provides an offset removed representation of Cb and the axis V provides an offset removed representation of Cr.

Although transmission of video data is more convenient in YCbCr form because of the unsigned nature of data, most color enhancement operations are defined in terms of the U and V components. The angle defined by the UV vector with the U axis determines the hue of its color. The three primary colors—red, green and blue and their complementary colors yellow, magenta and cyan are spaced out circularly in the U-V plane with a separation of approximately 60°.

The example color remapping system receives an input pixel and identifies the color of a pixel of an incoming video data stream. The pixel's color is determined by calculating the hue θ of the pixel as shown in FIG. 1. The chroma ρ (rho) of the pixel indicates how vivid the color is. If the chroma is 0, the pixel is a gray level value while a higher chroma value indicates a more vivid or saturated color. Hue can be calculated in hardware by using look up tables for dividing v by u and for the inverse tangent operation. The accuracy of the calculated hue is affected by the resolution of the look up tables. Chroma is ordinarily more straightforward to calculate because the square root operation is usually not needed and most operations can be defined in terms of squared chroma.

By changing the hue of a pixel, it is possible to make colors appear to be much different than they originally were. For example, pixels that are close to red can be made "redder" by moving them closer to the red axis, or they can be made "less redder" by moving them away from the red axis. Hue can be changed by rotating the color vector by an angle ϕ counter clockwise about the origin as defined below:

$$\begin{pmatrix} u' \\ v' \end{pmatrix} = \begin{bmatrix} \cos\phi & \sin\phi \\ -\sin\phi & \cos\phi \end{bmatrix} \begin{pmatrix} u \\ v \end{pmatrix} \tag{1}$$

Here u and v are the chroma components of the input pixel, while u' and v' are those of the output pixel after a rotation by ϕ degrees. The sine and cosine operations can be implemented using look up tables. Optimization can be done by storing only the sine values from 0° to 90° and noting that this is sufficient to calculate any other sine value. Also the cosine values can be calculated using the sine vales from 0° to 90°. The resolution of the look up table can be varied depending on the accuracy of the implementation.

The saturation of a pixel can be modified by moving it closer or away from the origin, while preserving its hue. The saturation of a pixel can be changed by multiplying the UV components of the pixel by the same saturation factor sf as shown below:

$$\begin{pmatrix} u' \\ v' \end{pmatrix} = \begin{bmatrix} sf & 0 \\ 0 & sf \end{bmatrix} \begin{pmatrix} u \\ v \end{pmatrix} \tag{2}$$

Here sf is a positive multiplying factor that can range from 0 to a value such as 5. A saturation factor of zero moves the pixel to the origin. A picture whose pixels are processed by multiplying by a saturation factor of zero becomes a gray level picture (black and white). Saturation factors greater than one result in vivid and colorful pictures that usually look more visually pleasing than the original. Care should be taken with high saturation factors, because the resulting YUV pixels may become invalid when converted back to RGB values (which are more limited than YUV values). This can lead to artifacts such as patchiness, loss of details and incorrect changes of colors.

Figure 2:
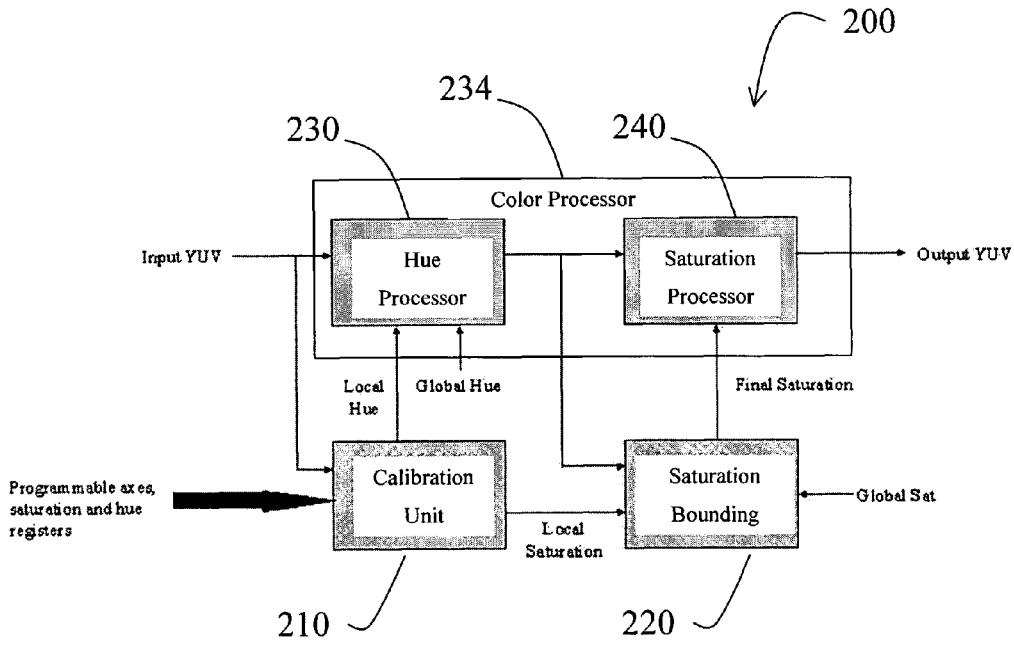
FIG. 2 is a block diagram of an intelligent color remapping system.

FIG. 2 is a block diagram of an intelligent color remapping system. The intelligent color remapping system (200) comprises a calibration unit (210), a bounded saturation unit (220), a hue processor (230), and a saturation processor (240). In operation, the calibration unit receives programming information for controlling system 200 from, for example, an OSD, control registers, and the like. Hue processor 230 and saturation processor 240 in some embodiments can be combined as color processor 234. Additionally, the functionality of the elements of the system can be shared or distributed amongst the various elements without necessarily affecting the functionality of the system itself (or elements of the system). The calibration unit determines a local hue and a local saturation value in response to the programming information and an input YUV input pixel.

The input video stream in YUV format is first subjected to a change in hue and then a change in saturation. The hue and saturation changes are of two types—local and global. Local refers to changes that depend on a pixel's color while global changes are applied for the whole frame. The local hue and saturation changes for different colors are specified using a set of programmable color axes.

Hue processor 230 receives the input YUV pixel and transforms the hue of the input YUV pixel in response to the local hue value and a global hue value. Bounded saturation unit 240 receives the hue-transformed pixel, the local saturation value, and a global saturation value and produces a final saturation value in response. Saturation processor 240 receives the hue-transformed YUV pixel and further transforms the saturation of the input YUV pixel in response to the final saturation value. The saturation processor outputs the transformed pixel as a YUV pixel.

An axis can be visualized as a spoke in the color plane wheel of FIG. 1. Each axis has a programmable position or angle (in terms of color hue), a hue change value and a saturation change value. By placing the set of axes at various positions around the color space wheel, different colors can be treated and enhanced separately. Local hue and saturation factors for each incoming pixel are calculated by evaluating the hue and saturation factors of the adjacent axes and interpolating between them. The final hue and saturation changes are a combination of the local change (which depends on the input pixel) and the global change (which is constant over the frame). The bounded saturation unit is used to prevent the occurrence of illegal YUV pixels when saturation changes are done. The concepts of color axes, calibration and calculation of local saturation and hue changes are explained below with reference to the following Figures.

Figure 3:
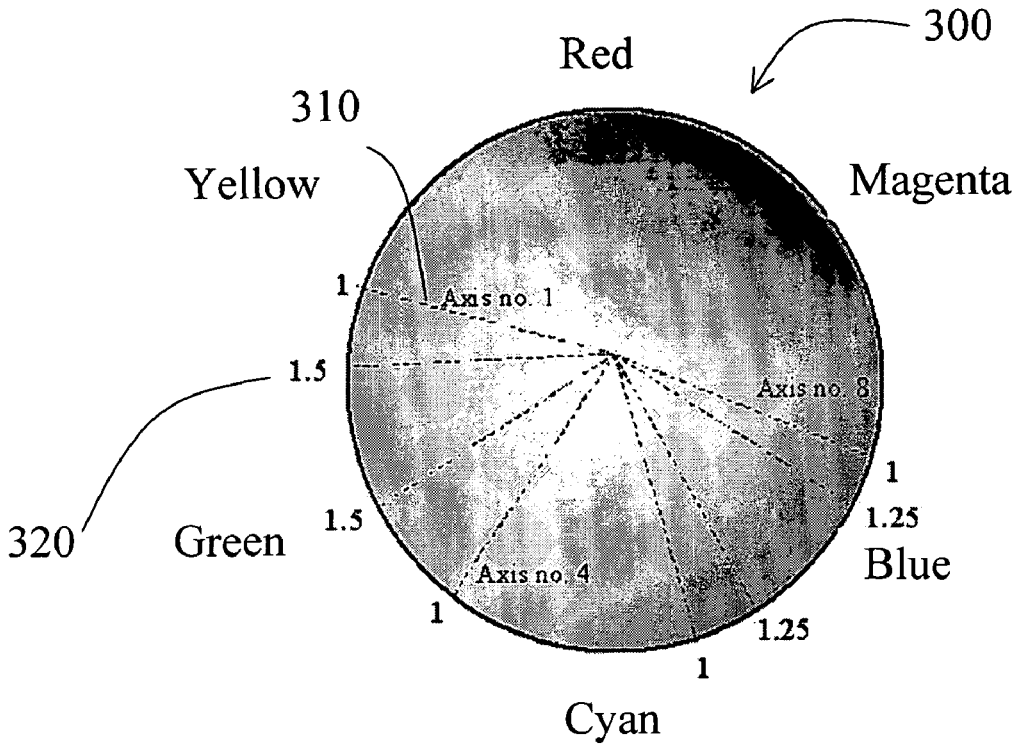
FIG. 3 illustrates an example YUV plane color wheel having eight axes.

FIG. 3 illustrates an example YUV plane color wheel having eight axes. Four of the axes (310) of color wheel 300 are in the green region while the other four are in the blue region. This particular axis positioning enhances the greenish and bluish regions while leaving other colors unchanged. The numbers (320) radially adjacent to the axes are the saturation change factors (multiplicative). This is an example of saturation change, but hue change can be specified similarly.

Table 1 shows the positions of the axes and the saturation change factors for the example given in FIG. 3, where the example system has a total of "N" axes assigned. The axes are defined in increasing order such that each position of axis n−1 is less than or equal to position of axis n (the hue is given as increasing from 0° to 360° in an anticlockwise direction). The roles of axis no. 0 and N−1 are explained below.

TABLE 1

| Axis No. | Position in degrees | Saturation Change |
|---|---|---|
| 0 | 0° | 1.0 |
| 1 | 170° | 1.0 |
| 2 | 182° | 1.5 |
| 3 | 220° | 1.5 |
| 4 | 240° | 1.0 |
| 5 | 285° | 1.0 |
| 6 | 295° | 1.25 |
| 7 | 325° | 1.25 |
| 8 | 335° | 1.0 |
| . | . | . |
| . | . | . |
| . | . | . |
| N-1 | 360° | 1.0 |

Using the above example that the axes have been positioned in the color wheel and saturation change factors have been defined as in Table 1, the process for an example input pixel whose hue is 200° follows. A first step in the calibration process is to find the neighboring axes on either side of this pixel. In this case, axis number 2 and axis number 3 neighbor the input pixel. Because both of these axes have a saturation factor of 1.5, the input pixel is assigned a local saturation factor of 1.5.

Using another example input pixel having a hue of 232°, the neighboring axes are axis number 3 and axis number 4. Because the two neighboring axes have different saturation factors, the local saturation factor that should be assigned to the input pixel is calculated using a linear interpolation between the axes as shown in Equation (3) below. In general let

| | |
|---|---|
| axis_low = | position of lower neighboring axis |
| axis_high = | position of higher neighboring axis |
| sf_low = | saturation change of lower neighboring axis |
| sf_high = | saturation change of higher neighboring axis |
| lsf = | local saturation to be assigned to input pixel |
| hue = | hue of input pixel |

Then using linear interpolation lsf can be calculated as $$lsf = \text{sf_high} + (\text{sf_high} - \text{sf_low})\frac{\text{hue} - \text{axis_high}}{\text{axis_high} - \text{axis_low}} \quad (3)$$

Thus lsf lies in between sf_low and sf_high and takes values between them depending on the distance (in terms of degrees) between the input point and the two neighboring axes. It is noted that this is the general case and can be used for the previous example where hue was 200° such that sf_high and sf_low are the same, and thus lsf=sf_high=sf_low as mentioned above.

The same procedure can be used for points in the bluish region and depending on the input pixel, where the neighboring axes are chosen accordingly and the corresponding saturation factors are used to interpolate the local saturation factor of the input pixel using Equation (3).

Special axes are defined for use with pixels that do not lie between user-specified axes. For example, an input pixel having a hue of 100° would have to be treated as a special case if axis number 0 did not exist. To handle this and other such exceptions, two axes having fixed positions of 0° and 360° are defined. Because these two axes are theoretically the same, they are assigned the same saturation factor, in this case 1. Thus any input point having a hue of less than 170° can be considered to lie between axes 0 and 1 and can be treated in a way similar to the other points described above. Because only eight axes are used in the example, higher numbered axes (e.g., axes numbered 9, 10, . . . , N−1) can be set to position 360° and saturation change factor of 1.

Next, the reasoning behind the placement of the axes in this example is considered. An objective of placing axes numbered 1-4 is to enhance a core region of green by increasing the saturation of a specific range of "grass greens." The core "grass" region is defined by axis nos. 2 and 3—182° to 220°. This region gets saturated by 1.5. A purpose of axes numbered. 1 and 4 is to define tapering regions on either side of the core region. If these tapering regions were not present, pixels that just lie inside the core region would be saturated by 1.5 while pixels that just lie outside the core region would be saturated by 1 (unchanged).

In an arbitrary real-world image of grass, each green pixel of the grass region is usually not exactly the same color. In other words, the various grass blades are of different shades and thus their hues are slightly different. It is quite possible that most pixels lie inside the core region, but many pixels lie just outside. Without the tapering regions, these two kinds of pixels undergo substantially different transformations and this could very well result in visible contouring of the picture. The tapering regions reduce this effect and produce a much cleaner picture.

The axes in the blue region enhance a specific range of blues, in this case "sky blues." Again a core region and tapering regions have been defined using axes nos. 5-8. All the other pixels that fall in the ranges 0°-170°, 240°-285° and 335°-360° remain untouched (saturation factor of 1). Thus the axis positioning of Example 1 enhances the colors grass green and sky blue while keeping other colors unchanged.

Hue change is applied in the same manner as saturation change. The local hue change factor lhf can be calculated using the equation $$lhf = \text{hf_high} + (\text{hf_high} - \text{hf_low})\frac{\text{hue} - \text{axis_high}}{\text{axis_high} - \text{axis_low}}$$

where hf_low and hf_high are the hue change factors of axis_low and axis_high respectively.

Figure 4:
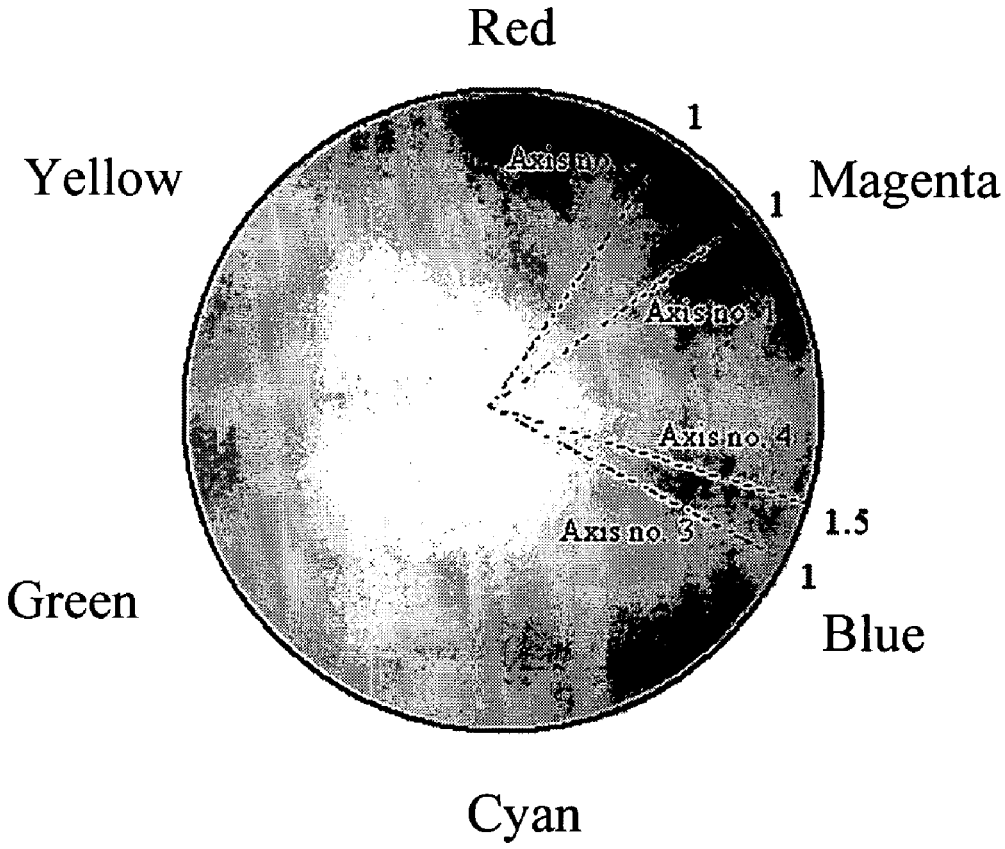
FIG. 4 illustrates an example YUV plane color wheel having four axes.

FIG. 4 illustrates an example YUV plane color wheel having four axes. This example shows how the usage of axes numbered 0 and N−1 helps the interpolation when input pixels whose hue lies close to 0° need to be enhanced. The positions of the axes of FIG. 4 are shown in Table 2. In this example, only violet-shaded colors are enhanced.

TABLE 2

| Axis No. | Position in degrees | Saturation Change |
|---|---|---|
| 0 | 0° | 1.5 |
| 1 | 40° | 1.5 |
| 2 | 60° | 1.0 |
| 3 | 320° | 1.0 |
| 4 | 335° | 1.5 |
| . | . | . |
| . | . | . |
| . | . | . |
| N-1 | 360° | 1.5 |

When an input pixel having a hue of 10° is encountered and axis numbers 0 and N−1 are not present, the interpolation can be troublesome since the neighboring axes are 1 and 4. This is because the neighboring axes lie on either side of the u-axis (hue=0° axis). To handle this case in a similar fashion to the others, we define axis no. 0 and axis no. N−1 to be positioned at 0° and 360° respectively such that the neighboring axes are axes numbers 0 and 1. It should also be noted that the saturation factors of axes numbered. 0 and N−1 are defined to be 1.5 so that the color enhancement scheme is logically consistent with axes numbers 1 and 4.

One common application in video enhancement is the color adjustment of the three primary colors—red, green and blue and their complementary colors—cyan, magenta and yellow. In a TV application, the control parameters (hue and saturation changes in our framework) may come from an on-screen OSD.

Figure 5:
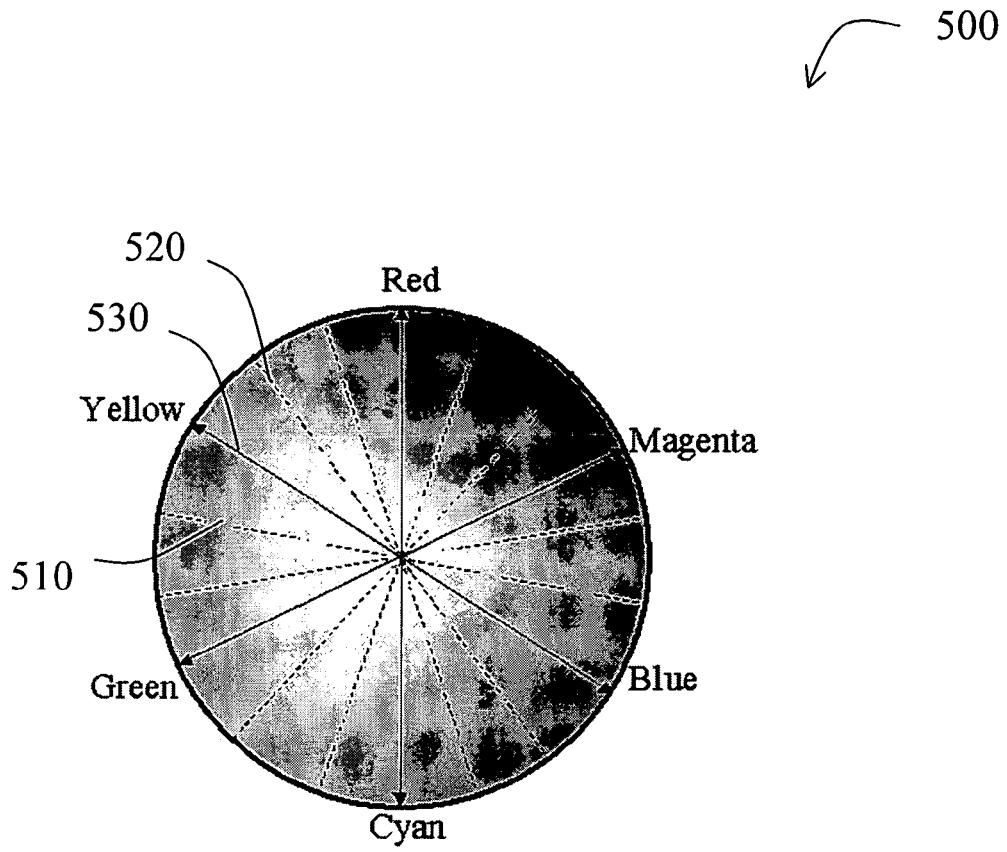
FIG. 5 illustrates an example YUV plane color wheel having six axes.

FIG. 5 illustrates an example YUV plane color wheel having six arrows that mark the three primary colors and their complementary colors. The positioning of axes to enhance the above mentioned six colors are shown by the dotted lines (see lines 510 and 520, for example). The colors are shown using thick arrows and two axes that each lie on both sides of each arrow (see line 530, for example). The two axes act as the control for each color that lies between the two axes. The two axes are programmed to have the same saturation and hue change so that the effect is uniform for all the pixels within the two axes (bordering the color to be enhanced). Thus, 14 axes are required (two axes for each of the six colors plus the two fixed axes) in this example.

Table 3 shows the position of the 14 axes for the ITU-601 (SDTV) specification of the YUV color space. Because the six colors lie approximately sixty degrees apart, the two axes on either side of each color are chosen to be 15° away from the center of the color such that the angle subtended by the two axes is 30°. There is also a 30° separation between the axes of neighboring colors. The input points that lie between the axes of neighboring colors are processed with parameters calculated by interpolating between the parameters of the colors on either side.

TABLE 3

| Axis No. | Position in degrees | Color |
|---|---|---|
| 0 | 0° | — |
| 1 | 5° | Blue |
| 2 | 37.5° | Magenta |
| 3 | 67.5° | Magenta |
| 4 | 95° | Red |
| 5 | 125° | Red |
| 6 | 155° | Yellow |
| 7 | 185° | Yellow |
| 8 | 217.5° | Green |
| 9 | 247.5° | Green |
| 10 | 275° | Cyan |
| 11 | 305° | Cyan |
| 12 | 335° | Blue |
| 13 | 360° | — |

The three examples of the previous section showed how local hue change was calculated using calibration of axes. For every input point, the final hue change $\phi$ is the sum of the local hue change and global hue change. This final hue change is then applied using (1).

The final saturation change sf for every input pixel is the product of its local saturation change (calculated from axis calibration) and the global saturation change. However since saturation changes are liable to cause YCbCr pixels to become invalid in RGB domain, the bounded saturation block calculates the maximum saturation each pixel can undergo while remaining valid. If this value is less than the final saturation for that pixel, it is used as the final saturation. Finally the pixel is saturated using Equation (2). It is noted that although the hue of a pixel may change after the being processed by the hue processor (230), the saturation change parameters are typically calculated using the hue of the pixel before the hue change of the pixel, if any.

An example framework for intelligent color enhancement by means of hue and saturation changes is described herein. The example system can be used for a variety of tasks and can be programmed to function in a set of pre-defined modes. The system works by calibrating a set of programmable color axes with respect to an input pixel. Each axis has a hue and saturation change factor and hence they can be positioned to enhance specific colors. This local hue and saturation enhancement can be combined with global enhancements for optimality. The system is well suited for implementation onto an ASIC/FPGA. Parameters such as resolution of color calculation, number of axes, etc. can be set depending on the system requirements and accuracy needed.

Various embodiments of the invention are possible without departing from the spirit and scope of the invention. The above specification, examples and data provide a complete description of the manufacture and use of the composition of the invention. For example, the architecture can be implemented using hardware, software, or a combination of both. Since many embodiments of the invention can be made without departing from the spirit and scope of the invention, the invention resides in the claims hereinafter appended.

We claim:

1. A method for processing an input pixel of an image frame, comprising:

identifying a color of the input pixel of an incoming video data stream;

mapping the pixel into a color plane based on the identified color of the input pixel;

determining positions of a plurality of color enhancement axes in the color plane, wherein each of the color enhancement axes is associated with a change factor;

identifying a region in the color plane into which the pixel is mapped, wherein identifying the region comprises identifying neighboring color enhancement axes for the input pixel;

calculating a change factor for the input pixel based on a linear interpolation between the change factors of the neighboring color enhancement axes associated with the identified region;

adjusting the color of the input pixel based on the change factor for the input pixel; and providing an output pixel in accordance with the adjusted color value.

2. The method of claim 1, wherein the change factor for the input pixel is used to determine a change in saturation of the input pixel.

3. The method of claim 2, wherein the change in saturation of the input pixel is further adjusted by a global saturation factor.

4. The method of claim 1, wherein the change factor for the input pixel is used to determine a change in hue of the input pixel.

5. A system for processing an input pixel of an image frame, comprising:

a calibration unit that is configured to determine a local hue and a local saturation value in response to programming information and an input YUV pixel and to map the pixel into a color plane based on the identified color of the pixel; and a color processing unit that is configured to:

determine positions of a plurality of enhancement axes in the color plane, wherein each of the color enhancement axes is associated with a change factor, identify a region in the color plane into which the pixel is mapped, wherein identifying the region comprises identifying neighboring color enhancement axes for the input pixel, calculate a change factor for the input pixel based on a linear interpolation between the change factors of the neighboring color enhancement axes associated with the identified region, adjust the color of the input pixel based on the change factor for the input pixel, and provide an output pixel in accordance with the adjusted color value.

6. The system of claim 5, wherein the change factor for the input pixel is used to determine a change in saturation of the pixel.

7. The system of claim 6, wherein the change in saturation of the input pixel is further adjusted by a global saturation factor.

8. The system of claim 5, wherein the change factor for the input pixel is used to determine a change in hue of the input pixel.

9. A system for processing an input pixel of an image frame, comprising:

means for identifying the color of a pixel of an incoming video data stream;

means for mapping the pixel into a color plane based on the identified color of the pixel;

means for determining positions of a plurality of color enhancement axes in the color plane, wherein each of the color enhancement axes is associated with a change factor;

means for identifying a region in the color plane into which the pixel is mapped, wherein identifying the region comprises identifying neighboring color enhancement axes for the input pixel;

means for calculating a change factor for the input pixel based on a linear interpolation between the change factors of the neighboring color enhancement axes associated with the identified region;

means for adjusting the color of the input pixel based on the change factor for the input pixel; and means for providing an output pixel in accordance with the adjusted color value.

10. The system of claim 9, wherein the change factor for the input pixel is used to determine a change in saturation of the input pixel.

* * * * *